US011946012B2

(12) United States Patent
Shinoda et al.

(10) Patent No.: US 11,946,012 B2
(45) Date of Patent: Apr. 2, 2024

(54) LUBRICATING OIL COMPOSITION

(71) Applicants: TOYOTA JIDOSHA KABUSHIKI KAISHA, Aichi (JP); SHELL LUBRICANTS JAPAN KABUSHIKI KAISHA, Tokyo (JP)

(72) Inventors: Noriaki Shinoda, Tokyo (JP); Shinji Saitou, Tokyo (JP); Misato Kishi, Aichi (JP); Shin-ichiro Shibata, Aichi (JP); Masashi Ogawa, Aichi (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/766,284

(22) PCT Filed: Oct. 23, 2020

(86) PCT No.: PCT/JP2020/039861
§ 371 (c)(1),
(2) Date: Apr. 4, 2022

(87) PCT Pub. No.: WO2021/079976
PCT Pub. Date: Apr. 29, 2021

(65) Prior Publication Data

US 2023/0002695 A1 Jan. 5, 2023

(30) Foreign Application Priority Data

Oct. 23, 2019 (JP) ..... 2019-192472

(51) Int. Cl.

| | |
|---|---|
| ***C10M 105/38*** | (2006.01) |
| ***C10M 105/24*** | (2006.01) |
| ***C10M 105/34*** | (2006.01) |
| ***C10M 107/04*** | (2006.01) |
| ***C10M 107/06*** | (2006.01) |
| ***C10M 169/04*** | (2006.01) |
| *C10N 20/02* | (2006.01) |
| *C10N 30/00* | (2006.01) |
| *C10N 30/02* | (2006.01) |
| *C10N 30/06* | (2006.01) |
| *C10N 40/04* | (2006.01) |

(52) U.S. Cl.
CPC ..... *C10M 105/38* (2013.01); *C10M 105/24* (2013.01); *C10M 105/34* (2013.01); *C10M 107/04* (2013.01); *C10M 107/06* (2013.01); *C10M 169/04* (2013.01); *C10M 2205/0206* (2013.01); *C10M 2205/022* (2013.01); *C10M 2205/024* (2013.01); *C10M 2205/173* (2013.01); *C10M 2207/126* (2013.01); *C10M 2207/2835* (2013.01); *C10M 2207/289* (2013.01); *C10N 2020/02* (2013.01); *C10N 2030/02* (2013.01); *C10N 2030/06* (2013.01); *C10N 2030/54* (2020.05); *C10N 2040/04* (2013.01)

(58) Field of Classification Search
CPC ..... C10M 105/38; C10M 105/24; C10M 105/34; C10M 107/04; C10M 107/06; C10M 169/04; C10M 2205/0206; C10M 2205/022; C10M 2205/024; C10M 2205/173; C10M 2207/126; C10M 2207/2835; C10M 2207/289; C10N 2020/02; C10N 2030/02; C10N 2030/06; C10N 2030/54; C10N 2040/04
See application file for complete search history.

(56) References Cited

U.S. PATENT DOCUMENTS

| | | | |
|---|---|---|---|
| 6,008,164 | A | 12/1999 | Aldrich et al. |
| 6,059,955 | A | 5/2000 | Cody et al. |
| 6,090,989 | A | 7/2000 | Trewella et al. |
| 6,103,099 | A | 8/2000 | Wittenbrink et al. |
| 6,332,974 | B1 | 12/2001 | Wittenbrink et al. |
| 6,420,618 | B1 | 7/2002 | Berlowitz et al. |
| 6,475,960 | B1 | 11/2002 | Berlowitz et al. |
| 6,506,297 | B1 | 1/2003 | Wittenbrink et al. |
| 6,599,864 | B1 | 7/2003 | Bertomeu |
| 6,610,636 | B2 | 8/2003 | Berlowitz et al. |
| 7,067,049 | B1 | 6/2006 | Baillargeon et al. |
| 8,071,515 | B2 | 12/2011 | Kamano et al. |

(Continued)

FOREIGN PATENT DOCUMENTS

| | | | |
|---|---|---|---|
| CN | 108085101 | A | 5/2018 |
| EP | 0668342 | A1 | 8/1995 |

(Continued)

OTHER PUBLICATIONS

International Search Report and Written Opinion received for PCT Patent Application No. PCT/JP2020/039861, dated Feb. 1, 2021, 10 pages.

(Continued)

*Primary Examiner* — Ellen M McAvoy
(74) *Attorney, Agent, or Firm* — SHELL USA, INC.

(57) ABSTRACT

The purpose of the present invention is to provide a lubricating oil composition capable of achieving good wear resistance and good scoring resistance of a bearing in addition to further fuel saving while maintaining durability and seizure resistance that can be used as a gear oil for a high-output, high-speed gear mechanism. A lubricating oil composition containing a combination of Fischer-Tropsch derived base oil having a low kinematic viscosity at high temperature, polyalphaolefin having a high kinematic viscosity at high temperature, and ester compound of a trivalent or higher polyol having a low kinematic viscosity at high temperature, and further contains a partial ester compound of an unsaturated fatty acid and a polyol, including a monoester compound of the unsaturated fatty acid and the polyol.

4 Claims, No Drawings

(56) References Cited

U.S. PATENT DOCUMENTS

| | | | | |
|---|---|---|---|---|
| 8,168,573 | B2 | 5/2012 | Moriki et al. | |
| 8,536,102 | B2 | 9/2013 | Buitrago | |
| 9,758,743 | B2 | 9/2017 | Knapton et al. | |
| 11,111,455 | B2 * | 9/2021 | Maruyama | C10M 169/041 |
| 11,130,926 | B2 | 9/2021 | Kamei et al. | |
| 11,254,890 | B2 * | 2/2022 | Maruyama | C10M 107/06 |
| 2005/0261145 | A1 * | 11/2005 | Rosenbaum | C10M 169/04 208/950 |
| 2006/0196807 | A1 * | 9/2006 | Rosenbaum | C10M 111/04 508/591 |
| 2011/0136714 | A1 | 6/2011 | Haigh et al. | |
| 2014/0187457 | A1 | 7/2014 | Kanga et al. | |
| 2014/0371117 | A1 * | 12/2014 | Mayernick | C10M 171/007 508/110 |
| 2016/0122683 | A1 | 5/2016 | Basu et al. | |
| 2019/0276764 | A1 * | 9/2019 | Maruyama | C10M 111/04 |
| 2020/0199475 | A1 * | 6/2020 | Flores-Torres | C10M 107/10 |
| 2020/0263105 | A1 | 8/2020 | Kamei et al. | |
| 2021/0054299 | A1 * | 2/2021 | Maruyama | C10M 105/24 |

FOREIGN PATENT DOCUMENTS

| | | | | |
|---|---|---|---|---|
| EP | 0776959 | A2 | 6/1997 | |
| JP | 2007100792 | A | 4/2007 | |
| JP | 2008285672 | A | 11/2008 | |
| JP | 2017115038 | A * | 6/2017 | |
| JP | 2017115038 | A | 6/2017 | |
| JP | 6516669 | B2 * | 5/2019 | |
| WO | WO-2008081287 | A2 * | 7/2008 | C10M 111/04 |

OTHER PUBLICATIONS

Office Action Received for Chinese Application No. 202080073873.9, dated Nov. 25, 2022, 16 Pages(8 Pages of English Translation and 8 Pages of Official Copy).

Office Action Received for Japanese Application No. 2019-192472, dated Aug. 15, 2023, 9 Pages (4 Pages of English Translation and 5 Pages of Official Copy).

* cited by examiner

LUBRICATING OIL COMPOSITION

CROSS REFERENCE TO RELATED APPLICATIONS

This is a National stage application of International application No PCT/JP2020/039861, filed Oct. 23, 2020, which claims priority of JP application No. 2019-192472, filed 23 Oct. 2019 which is incorporated herein by reference in its entirety.

TECHNICAL FIELD

The present disclosure relates to a lubricating oil composition, and more particularly to the lubricating oil composition used as an automotive gear oil and an automotive hypoid gear oil.

BACKGROUND ART

In recent years, load-bearing performance required for the automotive gear oil has reached a level of API (American Petroleum Institute) gear oil type GL-4 to GL-5 as an output of an automobile increases.

Further, for automobile gear units that are driven in response to various road conditions, it is necessary to assume driving at low speed conditions in which oil film is difficult to form. Moreover, a gear oil temperature rises due to heat generated by reduction in gear oil filling amount associated with downsizing of the unit, and oil film breakage due to reduction in viscosity tends to occur, and thus further durability is required for the gear oil.

The gear oil that requires such durability has generally employed SAE (Society of Automotive Engineers) viscosity number 90 in order to maintain oil film formation on a gear tooth surface.

However, on the other hand, fuel saving is also required, and in order to achieve this, it is necessary to reduce stirring resistance and to reduce the viscosity in order to address this. In order to satisfy these requirements for both gear tooth surface protection and low viscosity, if a method of increasing an amount of extreme pressure additive added to low viscosity base oil based on the conventional method is employed, phosphorus/sulfur-based additives used as the extreme pressure additive increase adverse effects of corrosiveness on parts containing copper components, and there is a high risk of shortening equipment life. Therefore, an additive composition for the gear oil that reduces such corrosion of copper and copper alloys has also been proposed (Patent Literature 1).

Also proposed is a technology that uses hydrocarbon-based synthetic oils and ester-based synthetic oils as the base oil to maintain the GL-5 level, while achieving low viscosity and achieving both durability and fuel saving (Patent Literature 2).

Further, a technique has also been proposed in which good seizure resistance of differential gear portion can be achieved by combining a Fischer-Tropsch derived base oil with a polyalphaolefin and an ester compound (Patent Literature 3). On the other hand, reduction in wear resistance of bearing due to reduction in viscosity requires countermeasures such as restriction of load conditions and change in structure of the bearing, and it was difficult to completely replace the gear unit that requires the conventional SAE viscosity number 90 with a low viscosity oil. Examples of wear of the bearing here include wear of a tapered roller bearing that supports a pinion gear on an input side of a hypoid gear. It is known that when the bearing is worn, a positional relationship between the pinion gear and a ring gear cannot be properly maintained, and as a result, the durability of the gear is reduced (Patent Literature 4).

Furthermore, it is known that reduction in viscosity of the lubricating oil affects an oil film forming ability, and causes a problem of scoring on the gear tooth surface or the like, and it is required to achieve good scoring resistance.

CITATION LIST

Patent Literature

[PTL 1]JP 2004-323850 A
[PTL 2]JP 2008-179780 A
[PTL 3]JP 2017-115038 A
[PTL 4]JP 2007-100792 A

SUMMARY OF INVENTION

Problem to be Solved by the Invention

An object of the present invention is to provide the lubricating oil composition that can be used as GL-5 level automotive gear oil or the like that can achieve good wear resistance and good scoring resistance of the bearing in addition to further fuel saving while maintaining durability and seizure resistance that can be used as the gear oil for a high-output, high-speed gear mechanism of a high-output automobile or the like.

Means for Solving Problem

In order to achieve the above object, the present invention relates to a lubricating oil composition containing: a Fischer-Tropsch derived base oil having a kinematic viscosity at 100° C. of 2 to 3.5 $mm^2/s$; a polyalphaolefin having a kinematic viscosity at 100° C. of 400 to 700 $mm^2/s$; an ester compound which is an ester of a trivalent or higher polyol having a kinematic viscosity at 100° C. of 3 to 6 $mm^2/s$; and a partial ester compound of an unsaturated fatty acid and a polyol. The partial ester compound of the unsaturated fatty acid includes a monoester compound of the unsaturated fatty acid and the polyol, and the lubricating oil composition has a kinematic viscosity at 40° C. of 25 to 45 $mm^2/s$.

The Fischer-Tropsch derived base oil is contained 30 to 80 mass % based on a total mass of the composition, the polyalphaolefin is contained 5 to 40 mass % based on the total mass of the composition, and the ester compound is contained 5 to 20 mass % based on the total mass of the composition.

The partial ester compound of the unsaturated fatty acid is contained 0.2 to 2 mass % based on the total mass of the composition. The unsaturated fatty acid is the unsaturated fatty acid having 10 to 20 carbon atoms.

The lubricating oil composition satisfies the GL-5 level in API gear oil type and has a viscosity index of 160 or more.

Effect of the Invention

According to the present disclosure, it is possible to provide the lubricating oil composition capable of achieving good wear resistance and good scoring resistance of the bearing in addition to further fuel saving while maintaining durability and seizure resistance that can be used as the gear oil for the high-output, high-speed gear mechanism of the high-output automobile or the like. Further, the lubricating oil composition satisfies the API GL-5 level and has a viscosity index of 160 or more in order to be used effectively in the automotive gear oil, the hypoid gear oil, and the like.

MODE FOR CARRYING OUT THE INVENTION

Hereinafter, the present invention will be described in detail. In order to save fuel consumption of a gear mechanism, it is necessary to achieve a high balance between mainly three points (1) to reduce slip between gear tooth surfaces caused by contact between metals, (2) to reduce energy required for a rotating gear to stir lubricating oil, and (3) to reduce sliding friction that occurs between the gear tooth surfaces with a lubricating oil film therebetween under high pressure conditions.

In order to achieve such a balance, it is usually conceivable to take measures (1) for the above (1), to reduce friction coefficient by effectively utilizing an oil-based agent added, (2) for the above (2), to reduce viscosity by using a low viscosity base oil, and (3) for the above (3), to reduce traction coefficient by selecting a base oil having a small shearing force.

In order to achieve good load bearing capacity, it is necessary, for example, (4) to form a strong metal film on the gear tooth surface by using an extreme pressure additive, and (5) to form an oil film that hinders contact between the metals. Further, retention of the oil film also affects fatigue life of a bearing.

In order to achieve such both fuel saving and load bearing capacity, it is one of important points to first select a main composition material of a lubricating oil composition. That is, a composition material having a low viscosity at a low temperature and a low stirring resistance, and a high viscosity at an extreme pressure state generated at high temperature is preferable. Those that are close to such a preferable composition material have a high viscosity index (VI) with a small change in viscosity with temperature, and a VI value of 160 or more is required, and particularly a high viscosity index of 180 or higher is required to achieve good seizure resistance and good wear resistance at high temperature.

In order to improve the VI, a Fischer-Tropsch derived base oil can be mixed and used in addition to a polyalphaolefin, particularly a highly viscous polyalphaolefin and an ester base oil.

In addition to such improvements in fuel saving and load bearing capacity, in order to improve the fatigue life in a differential gear of an automobile and the like, it is an effective means to mix and use the Fischer-Tropsch derived base oil in addition to the polyalphaolefin and an ester compound. Further, in order to achieve good wear resistance of the bearing supporting a pinion gear, it is effective to mix and use a partial ester compound of an unsaturated fatty acid and a polyol in addition to the Fischer-Tropsch derived base oil, the polyalphaolefin and the ester compound.

Furthermore, in order to achieve good scoring resistance on the gear tooth surface and the like, it is effective to use a combination of the Fischer-Tropsch derived base oil having a low kinematic viscosity at high temperature, the polyalphaolefin having a high kinematic viscosity at high temperature, and the ester compound of a trivalent or higher polyol having a low kinematic viscosity at high temperature. Components of the present invention will be described below.

The Fischer-Tropsch derived base oil, which is a component (A-1) of the present invention, is known in the art. The term "Fischer-Tropsch derived" means that the base oil is a synthetic product of Fischer-Tropsch method or is derived from the synthetic product. The Fischer-Tropsch derived base oil can also be referred to as a Gas-To-Liquids (GTL) base oil. Suitable Fischer-Tropsch derived base oils that can be conveniently used as the base oil in the lubricating oil composition are disclosed, for example, in EP0776959, EP0668342, WO97/21788, WO00/15736, WO00/14188, WO00/14187, WO00/14183, WO00/14179, WO00/08115, WO99/41332, EP1029029, WO01/18156 and WO01/57166.

The kinematic viscosity of the Fischer-Tropsch derived base oil is 2 to 3.5 $mm^2/s$ at 100° C. If the kinematic viscosity of the Fischer-Tropsch derived base oil at 100° C. is less than 2 $mm^2/s$, an amount of evaporation at high temperature is large, the viscosity of the composition is increased, and an effect of fuel saving is reduced. If the kinematic viscosity of the Fischer-Tropsch derived base oil at 100° C. exceeds 3.5 $mm^2/s$, it is not desirable because it is difficult to increase the VI of the composition by mixing with a high viscosity PAO.

The kinematic viscosity of the Fischer-Tropsch derived base oil at 100° C. is 2 to 3.5 $mm^2/s$, preferably 2.5 to 3.5 $mm^2/s$, and more preferably 2.5 to 3 $mm^2/s$ from a viewpoint of oil film formation.

The content of the Fischer-Tropsch derived base oil is 30 to 80 mass % based on a total mass (100 mass %) of the lubricating oil composition. If the content of the Fischer-Tropsch derived base oil is less than 30 mass %, in order for the lubricating oil composition to maintain the viscosity of about 25 to 45 $mm^2/s$ at 40° C., a large amount of polyalphaolefin (PAO) having a high viscosity (400 to 700 $mm^2/s$) is used and a ratio of synthetic oil is increased, which is not economical. If the content of the Fischer-Tropsch derived base oil exceeds 80 mass %, a blending amount of high viscosity polyalphaolefin (PAO) is limited, and it is necessary to increase a blending amount of a viscosity index improver in order to maintain the viscosity index of 160 or more of the composition while keeping the viscosity of the lubricating oil composition not more than 45 $mm^2/s$, which is not economical. The content of the Fischer-Tropsch derived base oil is 30 to 80 mass %, preferably 40 to 75 mass %, more preferably 50 to 75 mass %, even more preferably 60 to 75 mass %, and most preferably 65 to 70 mass % based on a total mass of the lubricating oil composition.

Examples of the Fischer-Tropsch derived base oil of the present invention include a Fischer-Tropsch derived base oil available on the market from Royal Dutch Shell plc as Risella X415.

One type of the Fischer-Tropsch derived base oil may be used alone, or two or more types may be used in combination.

The polyalphaolefin (PAO), which is a component (A-2) of the present invention, includes polymers of various alpha-olefins, or hydrides thereof. Any alpha-olefin can be used, and examples thereof include ethylene, propylene, butene, and α-olefins having 5 to 19 carbon atoms.

In production of the polyalphaolefin, one of the above alphaolefins may be used alone, or two or more of them may be used in combination.

As the alpha-olefin, ethylene and propylene are preferable, and a combination of ethylene and propylene is more preferable because it exhibits a high thickening effect. A ratio of the combination of ethylene and propylene may be any ratio, but the ratio of ethylene and propylene is preferably 20:80 to 80:20, and more preferably 30:70 to 70:30.

As the polyalphaolefin, those having various viscosities can be obtained depending on a type of alpha-olefin used, a degree of polymerization and the like, however, the polyalphaolefin having a high viscosity is preferably used.

As the polyalphaolefin, the high viscosity polyalphaolefin having a kinematic viscosity at 100° C. of 400 to 700 $mm^2/s$ is used. If the kinematic viscosity of the polyalphaolefin at 100° C. is less than 400 $mm^2/s$, it is not preferable because the effect of improving the viscosity index of the lubricating oil composition is low. If the kinematic viscosity of the polyalphaolefin at 100° C. exceeds 700 $mm^2/s$, it is not preferable because an oil film thickness of the lubricating oil composition is thin.

The kinematic viscosity of the polyalphaolefin at 100° C. is 400 to 700 $mm^2/s$, preferably 500 to 650 $mm^2/s$, and more preferably 550 to 650 $mm^2/s$.

The polyalphaolefin is blended in an amount of 5 to 40 mass % based on the total mass of the lubricating oil composition. If the content of the polyalphaolefin is less than 5 mass %, the viscosity of the lubricating oil composition is low and the oil film thickness is thin, which is not preferable. If the content of the polyalphaolefin exceeds 40 mass %, the viscosity of the lubricating oil composition is increased and fuel saving is reduced, which is not preferable. The content of the polyalphaolefin is 5 to 40 mass %, preferably 5 to 30 mass %, more preferably 7 to 20 mass %, and even more preferably 10 to 15 mass %.

One type of the polyalphaolefin may be used alone, or two or more types may be used in combination.

Examples of the ester compound, which is a component (A-3) of the present invention, include an ester of the trivalent or higher polyol.

A polyol ester given as an example of the component (A-3) includes a fatty acid ester obtained from at least one selected from the group consisting of trivalent and tetravalent polyols and their ethylene oxide adducts, and fatty acids having 4 to 12 carbon atoms. The ester of divalent or lower polyol may have a low kinematic viscosity and may result in excessive seal swelling. Hereinafter, the trivalent and tetravalent polyols and their ethylene oxide adducts will be described in sequence.

Specific examples of polyols having three or more hydroxyl groups include trimethylolethane, trimethylolpropane, trimethylolbutane, di-(trimethylolpropane), tri-(trimethylolpropane), pentaerythritol, di-(pentaerythritol), tri-(pentaerythritol), glycerol, polyglycerol (dimer to icosamer of glycerol), 1,3,5-pentantriol, sorbitol, sorbitan, sorbitol glycerol condensate, polyhydric alcohols such as adonitol, arabitol, xylitol and mannitol, sugars such as xylose, arabinose, ribose, rhamnose, glucose, fructose, galactose, mannose, sorbose, cellobiose, maltose, isomaltose, trehalose, sucrose, raffinose, gentianose and melezitose, partially etherified products thereof, and methyl glucosides (glycosides).

Of these, a polyol having three hydroxyl groups is preferable because it has a good balance between thermal oxidative stability, additive solubility and low temperature fluidity, and trimethylolpropane is most preferable.

The above-mentioned polyol ethylene oxide adduct is obtained by adding ethylene oxide to the above-mentioned polyol at a ratio of 1 to 4 mol, preferably 1 to 2 mol. Preferably, it is an ethylene oxide adduct of neopentyl glycol, trimethylolpropane, or pentaerythritol. If the number of added moles exceeds 4, the heat resistance of the fatty acid ester obtained may be reduced.

As the above-mentioned trivalent or tetravalent polyol and its ethylene oxide adduct, one type may be used alone, or two or more types may be used in combination.

The fatty acid used as a raw material for the ester compound which is the component (A-3) of the present invention is not particularly limited, and a saturated fatty acid, an unsaturated fatty acid, and a mixture thereof can be used, and further the fatty acid may be a linear fatty acid, a fatty acid having a branch, or a mixture thereof. Examples of the saturated fatty acid include the saturated fatty acid containing 50 mol % or more of linear saturated fatty acid and the saturated fatty acid containing 50 mol % or more of branched saturated fatty acid. The saturated fatty acid is preferable, and the linear saturated fatty acid is particularly preferable, because the fatty acid ester obtained has stability at high temperature, has an appropriate viscosity as the lubricating oil, and has a high viscosity index.

The above-mentioned fatty acid is a fatty acid having 4 to 12 carbon atoms, preferably a fatty acid having 6 to 12 carbon atoms, and more preferably a fatty acid having 8 to 10 carbon atoms. When fatty acids with 3 or less carbon atoms are used, an expected effect of adding the ester may not be sufficient. On the other hand, when the fatty acid having more than 12 carbon atoms is used, the obtained ester may be inferior in low temperature fluidity.

Examples of the linear saturated fatty acid include butyric acid, pentanoic acid, caproic acid, heptyl acid, capric acid, pelargonic acid, capric acid, undecanoic acid, and lauric acid.

Of these, caprylic acid and capric acid are preferable because they exhibit the most appropriate viscosity, and a mixture of caprylic acid and capric acid is more preferable.

The ester compound which is the component (A-3) of the present invention is obtained by reacting at least one selected from the group consisting of the above trivalent and tetravalent polyols and their ethylene oxide adducts with the fatty acid at any ratio. The ester compound is obtained by reacting 1 mol of the polyol and its adduct with the fatty acid preferably at a ratio of about 2 to 6 mol, more preferably about 2.1 to 5 mol.

The ester compound which is the component (A-3) of the present invention is preferably a complete ester compound in which alcohol portions are completely esterified, for example, a complete ester compound of the trivalent or higher polyol.

The ester compound which is the component (A-3) of the present invention is preferably a triol ester. The most preferred ester compound is an ester compound of trimethylolpropane and a linear carboxylic acid having 8 and 10 carbon atoms.

The ester compound which is the component (A-3) of the present invention is an ester compound having a kinematic viscosity at 100° C. of 3 to 6 $mm^2/s$. If the kinematic viscosity of the ester compound at 100° C. is less than 3 $mm^2/s$, an amount of evaporation loss at high temperature is large, which is not preferable. If the kinematic viscosity at 100° C. exceeds 6 $mm^2/s$, the low temperature fluidity is reduced, which is not preferable. The kinematic viscosity of the ester compound of the present invention at 100° C. is preferably 4 to 5 $mm^2/s$.

The ester compound which is the component (A-3) of the present invention is blended in an amount of 5 to 20 mass % based on the total mass of the lubricating oil composition. If the content of the ester compound is less than 5 mass %, solubility of the additive is lowered, which is not preferable. If the content of the ester compound exceeds 20 mass %, it is not preferable, for example, because it may be hydrolyzed, and competitive adsorption with the extreme pressure additive on a metal surface may occur. The ester compound of the present invention is blended in an amount of preferably 7 to 15 mass %, and more preferably 8 to 12 mass %.

One type of the ester compound may be used alone, or two or more types may be used in combination.

The partial ester compound of the unsaturated fatty acid and the polyol, which is a component (B-1) of the present invention, will be described. In the present invention, the partial ester compound of the unsaturated fatty acid and the polyol (B-1) includes a monoester compound of the unsaturated fatty acid and the polyol. Preferably, the partial ester compound of the unsaturated fatty acid and the polyol is the monoester compound of the unsaturated fatty acid and the polyol.

The unsaturated fatty acid in the partial ester compound of the unsaturated fatty acid and the polyol, which is the component (B-1) of the present invention, is practically the unsaturated fatty acid having 10 to 20 carbon atoms. If the number of carbon atoms of the unsaturated fatty acid is less than 10, it affects odor and corrosion of products, which is not preferable. On the other hand, if the number of carbon atoms exceeds 20, low temperature characteristics are deteriorated, which is not preferable. More preferably, it is the unsaturated fatty acid having 16 to 20 carbon atoms. Examples of the unsaturated fatty acid include myristoleic acid, palmitoleic acid, sapienic acid, oleic acid, elaidic acid, vaccenic acid, gadoleic acid, eicosenoic acid, linoleic acid, eicosadienoic acid, α-linolenic acid, γ-linolenic acid, pinolenic acid, α-eleostearic acid, 3-eleostearic acid, mead acid, dihomo-γ-linolenic acid, eicosatrienoic acid, stearidonic acid, arachidonic acid, eicosatetraenoic acid, adrenic acid, bosseopentaenoic acid, and eicosapentaenoic acid. The number of unsaturation in unsaturated fatty acid molecule is not particularly limited, however, the number of unsaturation is preferably 1 in terms of oxidative stability. For example, the palmitoleic acid, the oleic acid, the elaidic acid, the gadoleic acid, the eicosenoic acid and the like can be mentioned, and the oleic acid is particularly preferable.

The polyol in the partial ester compound of the unsaturated fatty acid and the polyol (B-1) of the present invention is not particularly limited as long as it is a divalent or higher polyol, however, the trivalent or higher polyol is preferable. Specifically, examples of the polyol include trimethylolethane, trimethylolpropane, trimethylolbutane, di-(trimethylolpropane), tri-(trimethylolpropane), pentaerythritol, di-(pentaerythritol), tri-(pentaerythritol), glycerol, polyglycerol (dimer to icosamer of glycerol), 1,3,5-pentantriol, sorbitol, sorbitan, sorbitol glycerol condensate, polyhydric alcohols such as adonitol, arabitol, xylitol and mannitol, sugars such as xylose, arabinose, ribose, rhamnose, glucose, fructose, galactose, mannose, sorbose, cellobiose, maltose, isomaltose, trehalose, sucrose, raffinose, gentianose and melezitose, and methylglucoside.

Of these, the trivalent and tetravalent polyols are more preferable in terms of solubility in the lubricating oil as a reaction product with the unsaturated fatty acid. Specific examples thereof include the glycerol, the trimethylolpropane, and the pentaerythritol. Of these, the glycerol and the trimethylolpropane are particularly preferable, and the glycerol is most preferable.

The partial ester compound of the unsaturated fatty acid and the polyol (B-1) of the present invention is a compound in which the polyol is not completely esterified. Specifically, examples of the partial ester compound include the monoester compound of the polyol, a polyol diester compound when the polyol is the trivalent polyol, and the polyol diester compound and/or a polyol triester compound when the polyol is the tetravalent polyol.

The partial ester compound of the unsaturated fatty acid and the polyol (B-1) of the present invention is preferably the monoester compound in terms of affinity for the metal surface and the solubility in the lubricating oil, and in order to exhibit a predetermined performance. When the partial ester compound contains a partial ester compound of a diester or higher ester compound, the monoester compound of the unsaturated fatty acid and the polyol is contained in an amount of 50 mass % or more, preferably 80 mass % or more based on a total of the partial ester compound. As the partial ester compound of the unsaturated fatty acid and the polyol (B-1) of the present invention, glycerol monooleate, trimethylolpropane monooleate and pentaerythritol monooleate are particularly preferable, and the glycerol monooleate is most preferable.

The partial ester compound of the unsaturated fatty acid and the polyol (B-1) of the present invention may be purchased as a commercially available product or prepared. Examples of the commercially available product include those available from Kao Corporation as Exepearl PE-MO and Emazole MO-50.

The partial ester compound of the unsaturated fatty acid and the polyol, which is the component (B-1) of the present invention, must be blended in an amount of 0.2 mass % or more based on the total mass of the lubricating oil composition, and is usually blended in a range of 0.2 to 2 mass %. If it is less than 0.2 mass %, an effect of improving the wear resistance cannot be obtained, which is not preferable. If it exceeds 2.0 mass %, it may lead to a decrease in oxidative stability and a decrease in solubility, which is not preferable. In order to maximize the performance by adding the component, it is particularly preferable to blend the component in the range of 0.5 to 1.5 mass %, and further in the range of 0.7 to 1.3 mass %.

In addition to the above components, various additives can be appropriately used as needed in order to further improve the performance. Examples of the additives include the extreme pressure additive, the viscosity index improver, an antioxidant, a metal deactivator, an oiliness improver, a defoamer, a pour point lowering agent, a cleaning dispersant, a rust inhibitor, an anti-emulsifier, and other known lubricating oil additives.

As the extreme pressure additive, a sulfur-based extreme pressure additive, a phosphorus compound, a combination thereof, a phosphorothionate, or the like can be used. As the sulfur-based extreme pressure additive, hydrocarbon sulfide represented by the following general formula (1), terpene sulfide, sulfurized fat and oil which is a reaction product of fat and oil and sulfur, or the like is used.

(Chemical 1)

$$R_1\text{-}Sy\text{-}(R_3\text{-}Sy)n\text{-}R_2 \quad (1)$$

In the above general formula (1), $R_1$ and $R_2$ are monovalent hydrocarbon groups, which may be the same or different, $R_3$ is a divalent hydrocarbon group, y is an integer of 1 or more, preferably 1 to 8, each y may be the same or a different number in a repeating unit, and n is 0 or an integer not less than 1.

Examples of the monovalent hydrocarbon groups of $R_1$ and $R_2$ include linear or branched saturated or unsaturated aliphatic hydrocarbon groups having 2 to 20 carbon atoms (for example, alkyl groups and alkenyl groups), and aromatic hydrocarbon groups having 6 to 26 carbon atom, and specific examples thereof include an ethyl group, a propyl group, a butyl group, a nonyl group, a dodecyl group, a propenyl group, a butenyl group, a benzyl group, a phenyl group, a tolyl group, and a hexylphenyl group.

Examples of the divalent hydrocarbon group of $R_3$ include linear or branched saturated or unsaturated aliphatic hydrocarbon groups having 2 to 20 carbon atoms, and aromatic hydrocarbon groups having 6 to 26 carbon atoms, and specific examples thereof include an ethylene group, a propylene group, a butylene group, and a phenylene group.

Typical hydrocarbon sulfides represented by the above general formula (1) are sulfur olefins and polysulfide compounds represented by the general formula (2).

(Chemical 2)

$$R_1\text{-}Sy\text{-}R_2 \quad (2)$$

In the above general formula (2), $R_1$ and $R_2$ are the same as the above general formula (1), and y is an integer of 2 or more.

Specifically, examples of the hydrocarbon sulfides include diisobutyl disulfide, dioctyl polysulfide, di-tertiary-nonyl polysulfide, di-tertiary butyl polysulfide, di-tertiary benzyl polysulfide, and sulfide olefins obtained by sulfurizing olefins such as polyisobutylene and terpenes with a sulfurizing agent such as sulfur.

Specific examples of the phosphorothionate include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl) phosphorothionate, tris(isopropylphenyl) phosphorothionate, tris(n-butylphenyl) phosphorothionate, tris(isobutylphenyl) phosphorothionate, tris(s-butylphenyl) phosphorothionate, and tris(t-butylphenyl) phosphorothionate.

Phosphorus compounds can also be used to impart extreme pressure properties and wear resistance. Examples of the phosphorus compounds suitable for the present invention include a phosphoric acid ester, an acidic phosphoric acid ester, an amine salt of acidic phosphoric acid ester, a chlorinated phosphoric acid ester, a phosphite ester, the phosphorothionate, zinc dithiophosphate, an ester of a dithiophosphoric acid and an alkanol or a polyether type alcohol, or a derivative thereof, a phosphorus-containing carboxylic acid, and a phosphorus-containing carboxylic acid ester.

Examples of the phosphoric acid ester include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tris(iso-propylphenyl) phosphate, triallyl phosphate, tricresyl phosphate, trixylenyl phosphate, cresyldiphenyl phosphate, and xylenyldiphenyl phosphate.

Specific examples of the acidic phosphoric acid ester include monobutyl acid phosphate, monopentyl acid phosphate, monohexyl acid phosphate, monoheptyl acid phosphate, monooctyl acid phosphate, monononyl acid phosphate, monodecyl acid phosphate, and monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate.

Examples of the amine salt of acidic phosphoric acid ester include salts of acidic phosphoric acid ester with amines such as methylamine, ethylamine, propylamine, butylamine, pentylamine, hexylamine, heptylamine, octylamine, dimethylamine, di-ethylamine, dipropylamine, dibutylamine, dipentylamine, dihexylamine, diheptylamine, dioctylamine, trimethylamine, triethylamine, tripropylamine, tributylamine, trypentylamine, trihexylamine, triheptylamine, and trioctylamine.

Examples of the phosphite ester include dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite.

The extreme pressure additives can be used alone or appropriately mixed and used. The extreme pressure additives may be added in an amount of 3 to 20 mass %, preferably 5 to 15 mass % based on the total mass of the lubricating oil composition. An extreme pressure additive package, which is a mixture of a sulfur-based compound and a phosphorus-based compound by selecting the additives, is suitable for product quality control. Examples of the extreme pressure additive package include Anglamol 99, 98A and 6043 from the Lubrizol Corporation, and HiTECH 340 and 380 series from Afton Chemical Corporation.

The viscosity index improver or the pour point lowering agent can be added to the lubricating oil composition of the present invention in order to improve viscosity characteristics and the low temperature fluidity.

Examples of the viscosity index improver include non-dispersion type viscosity index improvers such as polymethacrylates, ethylene-propylene copolymers, styrene-diene copolymers, olefin polymers such as polyisobutylene and polystyrene, and dispersion type viscosity index improvers obtained by copolymerizing them with a nitrogen-containing monomer. The viscosity index improver may be added in the range of 0.5 to 15 mass %, preferably 1 to 10 mass % based on the total mass of the lubricating oil composition. From an economic point of view, the viscosity index improver is preferably not used.

Examples of the pour point lowering agent include polymethacrylate-based polymers. The pour point lowering agent can be added in the range of 0.01 to 5 mass % based on the total mass of the lubricating oil composition. From the economic point of view, the pour point lowering agent is preferably not used.

As the antioxidant used in the present invention, those used for the lubricating oil are practically preferable, and examples thereof include a phenol-based antioxidant, an amine-based antioxidant, and a sulfur-based antioxidant. These antioxidants can be used alone or in combination in the range of 0.01 to 5 mass % based on the total mass of the lubricating oil composition.

Examples of the metal deactivator that can be used in combination with the lubricating oil composition of the present invention include benzotriazole, benzotriazole derivatives such as 4-alkyl-benzotriazoles such as 4-methyl-benzotriazole and 4-ethyl-benzotriazole, 5-alkyl-benzotriazoles such as 5-methyl-benzotriazole and 5-ethyl-benzotriazole, 1-alkyl-benzotriazoles such as 1-dioctylaminomethyl-2,3-benzotriazole, 1-alkyl-tolutriazoles such as 1-dioctylaminomethyl-2,3-tolutriazole, benzimidazole, benzimidazole derivatives such as 2-(alkyldithio)-benzimidazoles such as 2-(octyldithio)-benzimidazole, 2-(decyldithio)-benzimidazole and 2-(dodecyldithio)-benzimidazole, 2-(alkyldithio)-toluimidazoles such as 2-(octyldithio)-toluimidazole, 2-(decyldithio)-toluimidazole and 2-(dodecyldithio)-toluimidazole. These metal deactivators can be used alone or in combination in the range of 0.01 to 0.5 mass % based on the total mass of the lubricating oil composition.

The defoamer may be added to the lubricating oil composition of the present invention in order to impart anti-foaming properties. Examples of the defoamer suitable for the present invention include organo-silicates such as dimethyl polysiloxane, diethyl silicate and fluorosilicone, and non-silicone defoamers such as poly(alkyl acrylate). The defoamer can be added alone or in combination in the range of 0.0001 to 0.1 mass % based on the total mass of the lubricating oil composition.

Examples of the anti-emulsifier suitable for the present invention include known ones usually used as the lubricating oil additive. The anti-emulsifier can be added in the range of 0.0005 to 0.5 mass % based on the total mass of the lubricating oil composition.

The lubricating oil composition of the present invention can be prepared by mixing in any order any one, two or more of Fischer-Tropsch derived base oils, polyalphaolefin, ester compounds, and partially ester compounds of unsaturated fatty acids, and further any additives.

The lubricating oil composition of the present invention has a kinematic viscosity in the range of 25 to 45 $mm^2/s$ at 40° C. If it is lower than 25 $mm^2/s$, reliability of a differential may be impaired. If it is higher than 45 $mm^2/s$, expected fuel saving may not be obtained.

The lubricating oil composition of the present invention has a kinematic viscosity at 100° C. of 4 $mm^2/s$ or more, preferably 5 $mm^2/s$ or more and less than 10 $mm^2/s$, more preferably 6 $mm^2/s$ or more and less than 8 $mm^2/s$, and particularly preferably 6.3 $mm^2/s$ or more and less than 8.0 $mm^2/s$. If it is less than 4 $mm^2/s$, the reliability of the differential may be impaired. If it is 10 $mm^2/s$ or more, the expected fuel saving may not be obtained.

Further, the lubricating oil composition of the present invention has a viscosity index (VI) of 160 or more, and particularly 180 or more, in order to achieve both fuel saving and lubricity.

The lubricating oil composition of the present invention can further achieve the wear resistance of the bearing of the pinion gear of the actual differential. The wear resistance of the bearing of the pinion gear can be roughly determined by measuring an average value (mm) of wear scar diameters in a Shell four-ball test with reference to ASTM D4172. In the Shell four-ball test here, the average value (mm) of the wear scar diameters is measured under both conditions of spindle speed 1500 rpm, load 98N, oil temperature 135° C., 60 minutes of operation (condition 1), and spindle speed 1500 rpm, load 98N, oil temperature 160° C., and 60 minutes of operation (condition 2).

The lubricating oil composition of the present invention has an average value of wear scar diameters of 0.23 mm or less under any of the conditions (condition 1 and condition 2), and can achieve good wear resistance.

The lubricating oil composition of the present invention can achieve good scoring resistance by forming a sufficient additive film while having a lower viscosity. Scoring resistance performance of the lubricating oil composition of the present invention can be roughly determined by measuring a seizure load (lbs) in the Timken extreme pressure test with reference to JIS K2519. The Timken extreme pressure test here is to measure the seizure load, which is the maximum load that does not cause seizure, under a condition of a step load in which a rotational speed is 800 rpm, the oil temperature is 120° C., an initial load is 30 lbs, and the load is increased by 5 lbs every 2.5 minutes in a stepwise manner.

The lubricating oil composition of the present invention has a seizure load of 65 lbs and can achieve good scoring resistance performance.

As a result, the lubricating oil composition of the present invention can achieve scoring resistance equal to or higher than that of commercially available high-viscosity gear oil having an API gear oil type of GL-5 level and SAE viscosity grade of 75 W-85, and can achieve good seizure resistance of the differential gear.

The lubricating oil composition of the present invention can be used as a gear oil for a high-output, high-speed gear mechanism of a high-output automobile or the like. In particular, the lubricating oil composition maintains excellent durability and seizure resistance of the API gear oil type of GL-5 level, while achieving good wear resistance and good scoring resistance of the bearing in addition to further fuel saving, and can be used effectively in GL-5 level automotive gear oil, hypoid gear oil, and the like.

EXAMPLES

Hereinafter, the present invention will be specifically described with reference to Examples, Comparative Examples, and Reference Examples, however, the present invention is not limited to these Examples.

In preparing Examples and Comparative Examples, materials having the following compositions were prepared.

1. Fischer-Tropsch derived base oil (GTL base oil): A-1

(1-1) Fischer-Tropsch derived base oil having a kinematic viscosity at 100° C. of 2.7 $mm^2/s$ (1-2) Fischer-Tropsch derived base oil having a kinematic viscosity at 100° C. of 3.8 $mm^2/s$ (1-3) Fischer-Tropsch derived base oil having a kinematic viscosity at 100° C. of 7.8 $mm^2/s$ 2. Polyalphaolefin (PAO): A-2

(2-1) Low viscosity polyalphaolefin having a kinematic viscosity at 100° C. of 3.9 $mm^2/s$ (2-2) Polyalphaolefin consisting of high viscosity ethylene-propylene copolymer, and having a kinematic viscosity at 100° C. of 595 $mm^2/s$ (2-3) Polyalphaolefin consisting of medium viscosity ethylene-propylene copolymer, and having a kinematic viscosity at 100° C. of 38.6 $mm^2/s$ 3. Ester base oil: A-3

(3-1) TMP (Ester of trimethylolpropane and linear carboxylic acid having 8 and 10 carbon atoms); Ester base oil TMP having a kinematic viscosity at 100° C. of 4.42 $mm^2/s$ (3-2) DINA (diisononyl adipate); Ester base oil having a kinematic viscosity at 100° C. of 3.1 $mm^2/s$ 4. Saturated fatty acid Stearic acid: Reagent stearic acid, purity 90% or more 5. Partial ester of unsaturated fatty acid and polyol: B-1

Glycerol monooleate: Product obtained by purifying a commercially available glycerol monooleate having a mono ratio of 90% or more to produce one having a mono ratio of 95%.

6. Viscosity index improver:Polymethacrylate having a mass average molecular weight of 10,000 to 100,000; one having a kinematic viscosity at 100° C. of about 260 $mm^2/s$.

7. Sulfur-phosphorus based extreme pressure agent: Extreme pressure agent package (GL-5 additive package) containing olefin sulfide, phosphate ester amine salt, or the like, with a phosphorus content of about 1.3% and a sulfur content of about 23%.

Examples and Comparative Examples

Using the above-mentioned composition materials, the lubricating oil compositions of Example 1 and Comparative Examples 1 to 6 were prepared according to compositions shown in Table 1.

Reference Examples

Reference Example 1 is a passenger car gear oil, which satisfies conditions that the API gear oil type is GL-5 level and the SAE viscosity grade is 75 W-85.

Reference Example 2 is a passenger car gear oil, which uses the extreme pressure agent package having a high sulfur content. The passenger car gear oil satisfies conditions that the API gear oil type is GL-5 level and the SAE viscosity grade is 75 W-85.

Examination of Bearing Wear Prevention

For the lubricating oil composition of the present invention, the Shell four-ball test was conducted under two conditions with reference to ASTM D4172, assuming load and temperature of a worn portion under a specific pattern condition of the bearing assuming a pattern durability test of an actual taper roller bearing. The wear resistance of the lubricating oil compositions of Example 1, Comparative Examples 1 to 6 and Reference Example 1 was compared.

(Condition 1): With reference to ASTM D4172, the operation was carried out at the spindle speed of 1500 rpm, the load of 98 N, the oil temperature of 135° C., and 60 minutes. The wear scar diameter of a steel ball after the test was measured.

(Condition 2): With reference to ASTM D4172, the operation was carried out at the spindle speed of 1500 rpm, the load of 98 N, the oil temperature of 160° C., and 60 minutes. The wear scar diameter of a steel ball after the test was measured.

The Shell four-ball tests were all performed for two or more times and the average value of the wear scar diameters was compared. An acceptance criterion was 0.23 mm or less.

Examination of Scoring Resistance Performance

For the lubricating oil composition of the present invention, in the Timken extreme pressure test with reference to JIS K2519, under the condition of the step load in which the rotational speed is 800 rpm, the oil temperature is 120° C., the initial load is 30 lbs, and the load is increased by 5 lbs every 2.5 minutes in a stepwise manner, the seizure load, which is the maximum load that does not cause seizure, was compared for the lubricating oil compositions of Example 1 and Reference Example 2. The acceptance criterion was 60 lbs or more.

Test Results

Results of the tests are shown in Table 1.

DISCUSSION

As is apparent from the results shown in Table 1, the passenger car gear oil of Reference Example 1 satisfies the conditions that the API gear oil type is GL-5 level, the SAE viscosity grade is 75 W-85, and a Shell four-ball wear amount is small and it has sufficient durability (wear resistance of the bearing). However, since the kinematic viscosity is high, a stirring loss due to the oil is large, and it is difficult to achieve the expected fuel saving.

On the other hand, in all of Comparative Examples 1 to 6 in which the kinematic viscosity at 40° C. was adjusted as low as 35 $mm^2/s$ in order to suppress the stirring resistance for the purpose of improving the fuel saving, and further Comparative Examples 4 to 6 in which the viscosity index (VI) was adjusted to be 160 or more, the Shell four-ball wear amount is large and they do not meet the acceptance criterion of the wear scar diameter of 0.23 mm or less.

In Comparative Example 5, the ester compound TMP (A-3) of Example 1 was changed to the ester compound DINA, however, the Shell four-ball wear amount is large and it does not meet the acceptance criterion of the wear scar diameter of 0.23 mm or less.

In contrast, in Example 1 which is the lubricating oil composition of the present invention, the Shell four-ball wear amount is smaller than that of Comparative Examples 1 to 6, and further it is possible to achieve the high viscosity index (IV) of 180 or more.

Further, in Example 1, which is the lubricating oil composition of the present invention, even if the viscosity is low, in addition to a small amount of wear in the Shell four-ball test at high temperature, even in the Timken extreme pressure test assuming the scoring resistance performance, it has the performance exceeding that of Reference Example 2 that passes the extreme pressure test, and it was confirmed that it has excellent performance equal to or higher than that of a high viscosity differential gear oil.

| | | | | Example 1 | Comparative Example 1 | Comparative Example 2 | Comparative Example 3 | Comparative Example 4 |
|---|---|---|---|---|---|---|---|---|
| (A-1) | GTL base oil | 2.7 $mm^2/s$ @100° C. | mass % | 67 | | | 51 | 59 |
| | GTL base oil | 3.8 $mm^2/s$ @100° C. | mass % | | 16 | | | |
| | GTL base oil | 7.8 $mm^2/s$ @100° C. | mass % | | 63 | | | |

-continued

| | | | | | | | | |
|---|---|---|---|---|---|---|---|---|
| (A-2) | PAO | 3.9 $mm^2/s$ @100° C. | mass % | | | 73 | | |
| | PAO | 595 $mm^2/s$ @100° C. | mass % | 12 | | 6 | | |
| | PAO | 38.6 $mm^2/s$ @100° C. | mass % | | | | 28 | |
| | Viscosity index improver | PMA mass % | | | | | | 20 |
| (A-3) | Ester compound TMP | 4.42 $mm^2/s$ @100° C. | mass % | 10 | 10 | 10 | 10 | 10 |
| | Ester compound DINA | 3.1 $mm^2/s$ @100° C. | mass % | | | | | |
| | Saturated fatty acid | Stearic acid | mass % | | | | | |
| (B-1) | Partial ester compound of unsaturated fatty acid and polyol | Glycerol monooleate | mass % | 1 | 1 | 1 | 1 | 1 |
| | GL-additive package | S-P-based | mass % | 10 | 10 | 10 | 10 | 10 |
| | | Sulfur content | mass % | 2.3 | 2.3 | 2.3 | 2.3 | 2.3 |
| | | Phosphorus content | mass % | 0.13 | 0.13 | 0.13 | 0.13 | 0.13 |
| Kinematic viscosity | $mm^2/s$ @40° C. | | | 35.0 | 35.0 | 35.0 | 35.0 | 35.0 |
| | $mm^2/s$@100° C. | | | 7.34 | 6.37 | 6.77 | 6.85 | 8.23 |
| Viscosity index | | | | 182 | 137 | 158 | 160 | 223 |
| Shell four-ball test | Condition 1 [135° C.] | Wear scar diameter mm | | 0.20 | 0.25 | 0.23 | 0.25 | 0.24 |
| | Condition 2 [160° C.] | Wear scar diameter mm | | 0.23 | 0.26 | 0.27 | 0.27 | 0.28 |
| Scoring resistance | (Timken extreme pressure test) | Seizure load lbs | | 65 | | | | |

| | | | | Comparative Example 5 | Comparative Example 6 | Reference Example 1 | Reference Example 2 |
|---|---|---|---|---|---|---|---|
| (A-1) | GTL base oil | 2.7 $mm^2/s$ @100° C. | mass % | 67 | 67 | | |
| | GTL base oil | 3.8 $mm^2/s$ @100° C. | mass % | | | | |
| | GTL base oil | 7.8 $mm^2/s$ @100° C. | mass % | | | 56 | |
| (A-2) | PAO | 3.9 $mm^2/s$ @100° C. | mass % | | | | |
| | PAO | 595 $mm^2/s$ @100° C. | mass % | 12 | 12 | | |
| | PAO | 38.6 $mm^2/s$ @100° C. | mass % | | | 18 | |
| | Viscosity index improver | PMA mass % | | | | 5 | |
| (A-3) | Ester compound TMP | 4.42 $mm^2/s$ @100° C. | mass % | | 10 | 10 | |
| | Ester compound DINA | 3.1 $mm^2/s$ @100° C. | mass % | 10 | | | |
| | Saturated fatty acid | Stearic acid | mass % | | 1 | | |
| (B-1) | Partial ester compound of unsaturated fatty acid and polyol | Glycerol monooleate | mass % | 1 | | 1 | |
| | GL-additive package | S-P-based | mass % | 10 | 10 | 10 | |
| | | Sulfur content | mass % | 2.3 | 2.3 | 2.3 | 2.8 |
| | | Phosphorus content | mass % | 0.13 | 0.13 | 0.13 | 0.13 |
| Kinematic viscosity | $mm^2/s$ @40° C. | | | 35.0 | 35.0 | 74.5 | 71.5 |
| | $mm^2/s$@100° C. | | | 7.41 | 7.34 | 11.9 | 11.4 |
| Viscosity index | | | | 187 | 184 | 157 | 152 |
| Shell four-ball test | Condition 1 [135° C.] | Wear scar diameter mm | | 0.25 | 0.28 | 0.22 | — |
| | Condition 2 [160° C.] | Wear scar diameter mm | | 0.25 | 0.31 | 0.22 | — |
| Scoring resistance | (Timken extreme pressure test) | Seizure load lbs | | | | | 60 |

We claim:

1. A lubricating oil composition comprising (A-1) a Fischer-Tropsch derived base oil with a kinematic viscosity at 100° C. of 2 to 3.5 $mm^2/s$, (A-2) a polyalphaolefin with a kinematic viscosity at 100° C. of 400 to 700 $mm^2/s$, (A-3) a complete ester compound that is an ester of a trihydric or higher polyol with a kinematic viscosity at 100° C. of 3 to 6 $mm^2/s$, and (B-1) a partial ester compound of an unsaturated fatty acid and a polyol, wherein the partial ester compound of the unsaturated fatty acid and the polyol is a monoester of an unsaturated fatty acid and glycerol, wherein the unsaturated fatty acid in (B-1) is an unsaturated fatty acid having from 10 to 20 carbon atoms, and the lubricating oil composition has a kinematic viscosity at 40° C. of 25 $mm^2/s$ to 45 $mm^2/s$, wherein the lubricating oil composition comprises the Fischer-Tropsch derived base oil (A-1) in an amount from 30 to 80 mass % based on the total mass of the composition, the polyalphaolefin (A-2) in an amount from 5 to 40 mass % based on the total mass of the composition, and the ester compound (A-3) in an amount from 5 to 20 mass % based on the total mass of the composition, and wherein the lubricating oil composition comprises the partial ester compound of the unsaturated fatty acid (B-1) in an amount from 0.2 to 2 mass % based on the total mass of the composition.

2. A lubricating oil composition according to claim 1, wherein the ester compound (A-3) is an ester of a trihydric or tetravalent polyol and a saturated fatty acid.

3. A lubricating oil composition according to claim 2, wherein the ester compound (A-3) is an ester compound of trimethylolpropane and linear saturated carboxylic acids having 8 and 10 carbon atoms.

4. A lubricating oil composition according to claim 1, wherein the lubricating oil composition is used as a GL-5 automotive hypoid gear oil.

* * * * *